United States Patent [19]

Tiberg

[11] Patent Number: 4,585,062

[45] **Date of Patent: * Apr. 29, 1986**

[54] METHOD OF USING RODS RESISTANT TO HYDROSULFURIC ACID

[75] Inventor: Jan Tiberg, Hofors, Sweden

[73] Assignee: SKF Steel Engineering AB, Hofors, Sweden

[ * ] Notice: The portion of the term of this patent subsequent to Feb. 18, 2003, has been disclaimed.

[21] Appl. No.: 511,660

[22] Filed: Jul. 7, 1983

[30] Foreign Application Priority Data

Aug. 18, 1982 [SE] Sweden ..... 8204740

[51] Int. Cl.[4] ..... E21B 41/02

[52] U.S. Cl. ..... 166/244.1; 166/68; 148/36; 138/177; 72/365

[58] Field of Search ..... 166/244 C; 138/178, 138/177, DIG. 6; 148/36, 12 F; 75/123 L, 126 G, 128 E; 72/365, 378

[56] References Cited

U.S. PATENT DOCUMENTS

| | | | |
|---|---|---|---|
| 3,080,179 | 3/1963 | Huntsinger | 85/260 |
| 3,992,231 | 11/1976 | Timmons | 148/36 |
| 4,282,047 | 8/1981 | Yamagata et al. | 148/36 |
| 4,354,882 | 10/1982 | Greer | 148/36 |

FOREIGN PATENT DOCUMENTS

| | | |
|---|---|---|
| 1433719 | 11/1968 | Fed. Rep. of Germany . |
| 1013713 | 6/1962 | United Kingdom . |
| 1226512 | 4/1969 | United Kingdom . |
| 1345924 | 9/1971 | United Kingdom . |
| 1441164 | 7/1973 | United Kingdom . |
| 1471740 | 6/1974 | United Kingdom . |
| 1469489 | 1/1975 | United Kingdom . |
| 2088257 | 11/1981 | United Kingdom . |

OTHER PUBLICATIONS

Treseder, R.S. et al., *Factors in Sulfide Corrosion Cracking of High Strength Steels*, Corrosion, pp. 31–7, 2–68.

*Primary Examiner*—L. Dewayne Rutledge
*Assistant Examiner*—Deborah Yee
*Attorney, Agent, or Firm*—Armstrong, Nikaido, Marmelstein & Kubovcik

[57] ABSTRACT

High-strength rods, useful in an acid enviroment, in which the $H_2S$ partial pressure in gaseous phase may exceed 300 Pa or in which the $H_2S$ content in liquid phase may have a corresponding equilibrium pressure and/or in which $CO_2$ or other acidifying substances may be present are manufactured from cold-deformed carbon steel or cold-deformed low-alloyed steel. A preferred composition for the steel is:

C O–1.20%
Si O–1.0%
Mn O–3.0%
Cr O–2.0%
Ni O–1.0%
Mo O–1.0%
Cu O–1.0%
V O–0.3%
Nb O–0.2%
Ca O–0.05%
Fe together with incidental ingredients and impurities up to 100%

6 Claims, No Drawings

METHOD OF USING RODS RESISTANT TO HYDROSULFURIC ACID

The present invention relates to high-strength rods for use in acid environment, in which the $H_2S$ partial pressure in gaseous phase may exceed 300 Pa or in which the $H_2S$ content in liquid phase may have a corresponding equilibrium pressure and/or in which $CO_2$ or other acidifying substances may be present and particularly to pump rods for use in acid oil wells.

An estimated 20% of all oil wells being worked today are acid, and this figure is likely to increase. This means, for instance, that hydrosulfuric acid is present in the gaseous or liquid phase. Other corrosive substances may also be present, but $H_2S$ causes particular problems with respect to high-strength steels.

When the $H_2S$ content in gaseous phase exceeds about 300 Pa a phenomenon occurs which is known as "sulfide stress cracking", SSC. This cracking reduces the strength of the steel to far below its normal rupture and yield points.

Conventional oil pumps operating on the lever principle use long rods known as "sucker rods". These pump rods can be used in holes down to at least about 1000 m. The rods are subjected to great stress, especially in the longitudinal direction. If the rods are to be used in acid wells they must fulfil extremely stringent stipulations as to composition and machining.

These stipulations prescribed first of all either high or low alloyed and toughened steels. Furthermore, these steels may not have been cold-worked during the manufacturing process. Cold-straightening is accepted in exceptional cases, but only provided stress-relieving annealing is performed thereafter under carefully specified conditions.

Low-alloyed, toughened steel rods, and in exceptional cases high-alloyed steel rods, are usually used nowadays for high-strength production rods for use in an $H_2S$ environment. The drawbacks with both these types of rods include their being expensive, having poorer tolerances and surfaces than rods made of normal carbon steel or low-alloyed steel and furthermore being more difficult to machine. The object of the present invention, therefore is to eliminate the above drawbacks.

This is achieved according to the present invention by the use of rods manufactured from cold-deformed carbon steel or cold-deformed low-alloyed steel.

According to a preferred embodiment of the invention the steel is annealed and the annealing temperature is preferably ca 400°-675° C.

According to another embodiment of the invention the steel has the following composition by weight:

c 0–1.20%
Si 0–1.0%
Mn 0–3.0%
Cr 0–2.0%
Ni 0–1.0%
Mo 0–1.0%
Cu 0–1.0%
V 0–0.3%
Nb 0–0.2%
Ca 0–0.05%
Fe together with incidental ingredients and impurities up to 100%

According to yet another embodiment of the invention the steel has the following composition by weight:

C 0.05–0.55%
Si 0.10–0.50%
Mn 0.6–2.0%
Cr 0.0–0.50%
Ni 0.0–1.0%
Cu 0.0–0.50%
V 0.0–0.20%
Nb 0.0–0.10%
Ca 0.0–0.005%
Fe together with incidental ingredients and impurities up to 100%

According to yet another embodiment of the invention, the steel has the following composition by weight:

C 0.10–0.55%
Si 0.10–0.50%
Mn 0.80–1.80%
Cr 0.0–0.40%
Ni 0.0–1.0%
Cu 0.0–0.50%
V 0.0–0.20%
Nb 0.0–0.10%
Ca 0.0–0.005%
Fe together with incidental ingredients and impurities up to 100%

According to yet another embodiment of the invention the steel has an extremely low sulfur content, ca 0.0–0.005% S by weight. Normal sulfur contents are between ca 0.005–0.050% S.

As intimated above, cold-working produces better surfaces and tolerances, better machinability than after toughening, and most importantly, considerably lower costs in comparison with high or low-alloyed and toughened.

It has now quite surprisingly been found that better resistance to SSC is obtained with steel rods according to the invention than with high-alloyed or toughened, low alloyed steel, which was earlier considered quite unthinkable. Reference is made here to NACE Standard MR-01-75 (1980 Revision) "Material Requirement—Sulfide Stress Cracking Resistant Metallic Material for Oil Field Equipment", issued by the National Association of Corrosion Engineers. This standard in turn refers primarily to the API standards 5A and 5AX. It is clear from this standard that low-alloyed, high-strength, cold-worked steel has hitherto been considered quite unusable for extracting oil from acid oil wells.

Experiments performed, described in the examples, show however that even better resistance is obtained for cold-worked, annealed, low-alloyed steels according to the present invention than with the steel grades previously stipulated. The theory behind this phenomenon has not been fully determined, but a contributory factor may well be that the cold-deformation results in increased dislocation density, thus increasing the strength of the steel. During annealing at moderate temperatures, i.e. 500°-650° C., inner stresses are caused in the material, which might otherwise contribute to SSC. At the same time an extremely fine-grained substructure occurs, the sub-particle size being 0.2–0.5 μm.

The steel strength is thus obtained by working the steel. According to one embodiment of the invention the rod is manufactured by means of cold-rolling. The degree of cold-deformation shall then be at least 5%, preferably at least 25%. The lower yield point of the steel shall be at least 550 Mpa, preferably at least 650 Mpa.

According to another embodiment of the invention the rod is manufactured by means of cold-drawing. In this case the degree of cold-working shall be at least 5% and shall have a lower yield point of at least 550 MPa.

The following Example is given to illustrate the invention.

Comparative experiments are described below, illustrating the use, according to the invention, of cold-worked steel in an acid environment.

In the experiments, rods manufactured from grade SKF 280 steel, in the first case cold-worked and annealed (1.5 h at 515° C.) and in the second case hardened and annealed (2 h at 570° C.), were tested.

Table 1 below shows the chemical analysis of the steel tested and Table 2 below shows the mechanical properties of the test pieces of cold-rolled or hardened, annealed SKF 280.

TABLE 1

| | |
|---|---|
| C | 0.18% |
| Si | 0.37% |
| Mn | 1.46% |
| P | 0.014% |
| S | 0.020% |
| Cr | 0.07% |
| Ni | 0.06% |
| Mo | 0.02% |
| V | 0.10 |
| Fe together with incidental ingredients and impurities - balance. | |

TABLE 2

| | (Mechanical properties) | |
|---|---|---|
| | Cold-rolled | Toughened |
| $R_{eL}$ (MPa) | 800 | 866 |
| $R_m$ (MPa) | 850 | 906 |
| $A_5$ (%) | 19 | 19 |
| Z (%) | 59 | 64 |
| HB | 269 | 300 |

The following test environments were used:

1. 5% NaCl, saturated $H_2S$=cotton solution
2. 5% NaCl, saturated $H_2S$+0.5 $HA_c$=NACE solution.

The testing method used was the 3-point bending test and the testing time was 100 h.

In test environment No. 1 both rods were able satisfactorily to withstand loading in the outer fibre in excess of 800 MPa but in test environment No. 2, while the cold-rolled sample, in accordance with the invention, was able satisfactorily to withstand an outer fibre loading in excess of 800 MPa, the toughened rod ruptured at a loading of about 500 MPa and ruptured again at a loading of about 600 MPa.

The test shows that the cold-rolled rods used according to the present invention are more resistant to $H_2S$ stress corrosion than the toughened rods.

The conclusion can be drawn from the results obtained that the cold-rolled rods, i.e. of SKF 280, according to the invention are at least as good as the toughened rods of types 4130 or 4140 or other 41xx types conventionally recommended for use in acid wells.

I claim:

1. A method of using a high-strength steel rod in an acid environment, comprising immersing and using said rod in an acid-environment in which the $H_2S$ partial pressure in gaseous phase is at least 300 Pa or in which the $H_2S$ content in liquid phase has a corresponding equilibrium pressure, said steel being carbon steel or low-alloyed steel in a cold-deformed condition wherein the degree of cold-deformation is at least 5% to increase resistance to sulfide stress cracking, and wherein said rod is used in said acid-environment in the cold deformed condition without subsequent toughening by austenitizing, said steel having a lower yield point of 550 MPa and consisting essentially of by weight:

C 0–1.20%
Si 0–1.0%
Mn 0–3.0%
Cr 0–2.0%
Ni 0–1.0%
Mo 0–1.0%
Cu 0–1.0%
V 0–0.3%
Nb 0–0.2%
Ca 0–0.05%
Fe together with incidental ingredients and impurities up to 100%.

2. A method according to claim 1, wherein the steel has the following composition by weight:

C 0.05–0.55%
Si 0.10–0.50%
Mn 0.6–2.0%
Cr 0.0–0.50%
Ni 0.0–1.0%
Cu 0.0–0.50%
V 0.0–0.20%
Nb 0.0–0.10%
Ca 0.0–0.005%
Fe together with incidental ingredients and impurities up to 100%.

3. A method according to claim 1, including the step of pumping oil from an acid oil well, and wherein said rod is a pump rod in an oil well pump.

4. A method according to claim 1 wherein the steel has been annealed following cold-deformation at a temperature of from between about 400° C. and about 675° C.

5. A method according to claim 4 wherein the steel has been annealed following cold-deformation at a temperature of from between about 500° C. and about 650° C.

6. A method according to claim 1 wherein the steel contains not more than 0.005% by weight S.

* * * * *